United States Patent [19]

Srowig

[11] 4,138,624

[45] Feb. 6, 1979

[54] COLOR TELEVISION CATHODE RAY TUBE GUN MOUNTING

[75] Inventor: Reinhard Srowig, Unterelchingen, Fed. Rep. of Germany

[73] Assignee: Licentia Patent-Verwaltungs GmbH, Frankfurt am Main, Fed. Rep. of Germany

[21] Appl. No.: 833,706

[22] Filed: Sep. 15, 1977

[30] Foreign Application Priority Data

Sep. 22, 1976 [DE] Fed. Rep. of Germany ..... 2642560

[51] Int. Cl.[2] ..... H01J 29/02

[52] U.S. Cl. ..... 313/417; 313/457

[58] Field of Search ..... 313/417, 457, 409, 411, 313/412, 413, 414

[56] References Cited

U.S. PATENT DOCUMENTS

| | | | |
|---|---|---|---|
| 3,974,416 | 8/1976 | van der Goot et al. | 313/417 |
| 4,061,942 | 12/1977 | Andre | 313/417 |

*Primary Examiner*—Robert Segal
*Assistant Examiner*—Darwin R. Hostetter
*Attorney, Agent, or Firm*—Spencer & Kaye

[57] ABSTRACT

A color television picture tube in-line gun assembly in which the individual guns are secured together with the aid of fastening clamps which are constructed to progressively tilt the outermost guns relative to the center gun during heating up of the tube in a manner to compensate for skewing of the beam axis as a result of such heating.

6 Claims, 4 Drawing Figures

COLOR TELEVISION CATHODE RAY TUBE GUN MOUNTING

BACKGROUND OF THE INVENTION

The present invention relates to a color television cathode-ray tube of the type having three electron beam generating systems, or guns, arranged in a plane, or in line.

In such tubes, the electron beam axes of the three systems intersect at a close distance in front of the phosphor screen and the electron beam generating systems are fastened to insulated bars by means of fastening clamps so that there is a force locking, or positive, fastening of each one of the two outer electron beam generating systems to the center electron beam generating system through the intermediary of at least one insulating bar.

Color picture tubes employing three beam generating systems disposed in a plane are known as in-line tubes.

It has been found during operation of such tubes that with increasing heating of the beam generating systems, color fringes can often be noted on the screen, obviously resulting from the fact that the beam convergence point of the three electron beam generators, which is fixed during assembly of the system so that it lies essentially in the plane of the color shadow mask, is shifted along the longitudinal axis of the tube.

One reason for this undesirable phenomenon is believed to be the fact that the individual electrodes of the beam generating systems expand to a different degree with respect to the electron emitting cathodes, depending on their respective positions, and thus the beam passage openings of the individual electrodes are no longer aligned with one another. This causes the electron beam to be skewed so that the angles at which the electron beams are to impinge with respect to one another are no longer maintained.

Such skewing is particularly noticeable where a high voltage difference exists between two adjacent electrodes so that it is quite possible that even upon a slight shift due to heating, the electron beam may be skewed to a greater extent in the area of the focusing lens where there are generally greater differences in voltage than at a point where the voltage differences are less but the shifts due to heating are greater.

SUMMARY OF THE INVENTION

It is an object of the present invention to arrange electron beam generating systems of such a tube so that the electron beam direction shifts occurring due to heat influence are substantially compensated.

This and other objects are achieved according to the present invention, by arranging the fastening clamps of the center electron beam generating system so that, upon heating of the electron beam generating systems during operation, the beam axes of the two outer electron beam generating systems become tilted with respect to the beam axis of the center system by such an amount that the effect of skewing or bending of the electron beams from the outer systems due to heating of the outer beam generating systems is substantially compensated.

With the arrangement according to the invention it is possible to maintain the beam convergence point substantially in the plane of the shadow mask even with different heat conditions in the region of the electron beam generating systems. Annoying color fringes are thus substantially avoided, particularly during the period until the final thermal equilibrium state of the tube is reached, which generally occurs about 20 minutes after the receiver is turned on.

DESCRIPTION OF THE PREFERRED EMBODIMENTS

Figure 1:
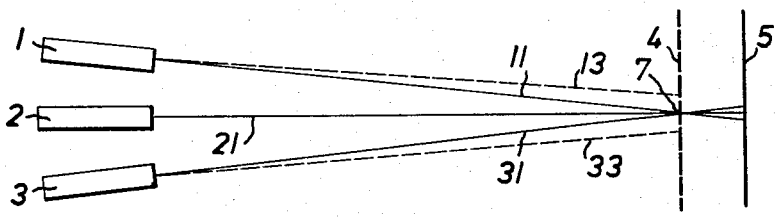
FIG. 1 is a schematic, pictorial view of the spatial relation between the electron guns and the mask and phosphor screens of an in-line gun color picture tube.

FIG. 1 provides a schematic illustration of the path of the electron beams in an in-line gun-type color picture tube. The three electron beam generating systems, or guns, 1, 2 and 3 are tilted slightly with respect to one another at an appropriate angle. The tilt angle is very slight since the three beam generating systems are disposed very close together and the distance from the guns to the shadow mask 4 is relatively large. The three guns emit respective electron beams 11, 21 and 31 which converge at point 7 in the plane of the shadow mask 4 and impinge on the phosphor screen 5 after passing through shadow mask 4.

When the beam generating systems 1, 2 and 3 are heated during operation, mainly by the heat generated in their cathodes, it is found that the beam axes, and hence the electron beams, of the two outer systems 1 and 3 change their direction, particularly in the directions shown by broken lines 13 and 33. The beam convergence point is thus shifted along the longitudinal axis of the tube into a plane which lies outside the plane of the shadow mask. FIG. 1 shows this tilting, or skewing, of the electron beams 13 and 33 as a result of heat in an exaggerated manner so as to better illustrate its adverse effect.

The present invention provides a compensating physical tilting of the two outer systems 1 and 3 in dependence on the degree of heating of the beam generating systems so that the tilting, or skewing, of the beam axes of the outer systems is substantially compensated and the beam convergence point 7 will remain substantially in the plane of the shadow mask 4 even when the systems are heated and during the tube warm-up stages.

Figure 2:
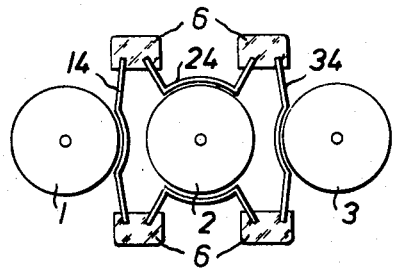
FIG. 2 is a frontal view of the arrangement of the guns and illustrating one preferred embodiment of the invention.

FIG. 2 is a frontal view of an in-line system which shows that the beam axes of all three systems 1, 2 and 3 lie in a plane and the three systems are mounted by means of fastening clamps 14, 24 and 34. The free ends of these fastening clamps 14, 24 and 34 are fused into glass bars 6. The glass bars 6 are arranged to be essentially mutually parallel and parallel to the common plane of the beam axes of the generating systems. The force locking, or positive, connection of the two outer systems 1 and 3 with the center system 2 is effected each time through the intermediary of such glass bars 6. The arrangement of the fastening clamps 24 of the center beam generating system 2 is symmetrical with respect to the beam axis of the center system and with respect to the common plane of the beam axes of the three systems.

The fastening clamps 14 and 34 of the two outer systems 1 and 3 are arranged to also be symmetrical to the common plane of the beam axes of the three electron beam generating systems but not symmetrical to the electron beam axis of each of the two outer systems 1 and 3.

Figure 4:
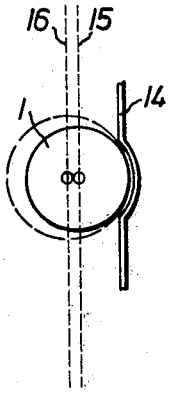
FIG. 4 is a detail view illustrating the function of a portion of the arrangement of FIGS. 2 and 3.

FIG. 4 shows, again in an exaggerated manner, for beam generating system 1 how the position of an individual electrode e.g. the lens electrode, of each outer beam generating system may change due to heating. The position resulting from heating is shown in broken lines. It can be seen, for example, that the lens electrode of beam generating system 1 increases in size as a result of heating and thus the electron passage opening of this electrode is shifted from original position 15 to position 16. Similar shifts may occur in the electron passage openings of the other grids.

Figure 3:
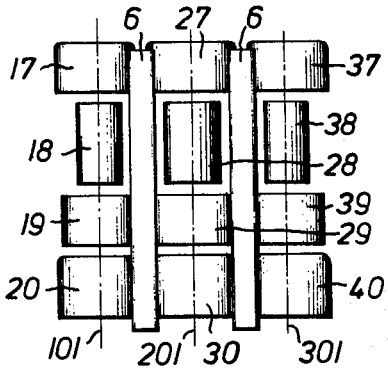
FIG. 3 is a plan view of the arrangement of FIG. 2.

FIG. 3 is a plan view of the three electron beam generating systems. Four electrodes are shown for each system, the individual electrodes being designed to be axially symmetrical to the respective beam axis. The outer system 1 is composed of electrodes 17, 18, 19 and 20, while the center system 2 is composed of electrodes 28, 29 and 30, and the outer system 3 has electrodes 37, 38, 39 and 40. Electrodes 20, 30 and 40 are assumed to constitute the cup-shaped control electrodes, or grids, which enclose the cathodes so that a substantial portion of the heat is generated in the area of these electrodes 20, 30 and 40.

In contradistinction thereto, electrodes 17 and 18 or 27 and 28 or 37 and 38, respectively, constitute an electron lens so that a very high voltage difference is present between these electrodes with the result that even with a slight shift in the electrode positions, the resulting skewing of the beams could be substantial.

According to the present invention, the beam axes 101 and 301 are tilted with respect to beam axis 201 during heating so that the tilting of the electron beam axes of the two outer systems as a result of heating is substantially compensated. In a preferred embodiment this is effected in such a manner that, by suitable selection and construction of the fastening clamps 24 for the center beam generating system, the insulating bars 6 are caused to tilt.

According to a preferred embodiment, this can be realized by making the fastening clamps for the electrode 30 of the center system of a material that, due to its particular coefficient of thermal expansion, will expand more than the fastening clamps of electrodes 27, 28, and 29 of the center system. If necessary, it may be advisable to use fastening clamps for electrode 29 having a higher coefficient of thermal expansion than the clamps for electrode 30 of the center system, because of the lower temperature of electrode 29. The expansion coefficient of the clamps of electrode 30 may be $12.10^{-6}$° C.$^{-1}$ and that of the clamps of the electrodes 29, 28 and 27 maybe $18.10^{-6}$° C.$^{-1}$.

Upon heating of the electrodes, the glass bars 6 are pressed apart along planes parallel to the common plane of the beam axes of the three systems and the bars thus become tilted relative to one another. Since, however, the outer electron beam generating systems 1 and 3 are also fastened to these glass bars 6, as shown in FIG. 2, the electron beam axes 101 and 301 of the two outer systems also become tilted relative one another or with respect to the electron beam axis 201, respectively. The tilting is here effected in the sense of displacing the beam convergence point 7 in the direction toward the electron beam generating systems so that the undesirable angular displacement of electron beams 13 and 33 of the individual electrodes of the outer systems, which displacement is a result of heat and the configuration of the individual electrodes as described in connection with FIG. 1, is substantially cancelled out.

The strength of the fastening clamps 24 is selected so that the described thermal expansion of the clamps will cause only slight stresses within the glass bars 6.

It will be understood that the above description of the present invention is susceptible to various modifications, changes and adaptations, and the same are intended to be comprehended within the meaning and range of equivalents of the appended claims.

What is claimed is:

1. In a color television cathod-ray picture tube composed of three electron beam generating systems arranged in a line, with their electron beam axes lying in a common plane, a phosphor screen, and means supporting the beam generating systems in positions for causing the beam axes of the three systems to intersect at a point of convergence a short distance in front of the phosphor screen, the supporting means including insulating bars and fastening members positively connecting each of the outer ones of the generating systems to the center generating system through the intermediary of one of the insulating bars, the improvement wherein said fastening members comprise fastening clamps connected between said center generating system and said insulating bars and having a form which varies with temperature for displacing each said outer generating system relative to said center generating system during heating of said systems in a manner to tilt the electron beam axes of said outer systems relative to that of said center system by an amount which substantially compensates for skewing of the beam axes of said outer systems due to heating.

2. An arrangement as defined in claim 1 wherein the longitudinal dimension of said insulating bars is oriented approximately parallel to the longitudinal axis of said tube and there are at least two said fastening clamps arranged so that when said systems are heated during operation of said tube, said insulating bars are tilted in directions parallel to the common plane of the electronic beam axes of said three beam generating systems.

3. An arrangement as defined in claim 2 wherein the two outer beam generating systems are so constructed that when heated during operation, said fastening clamps act to tilt their electron beam axes in directions which act to increase the distance between the convergence point of the beams and said phosphor screen.

4. An arrangement as defined in claim 3 wherein said fastening clamps are arranged to be symmetrical to the beam axis of said center electron beam generating system and to the common plane of the beam axes of said three beam generating systems.

5. An arrangement as defined in claim 4 wherein said fastening members further comprise fastening clamps each connected between one of said outer generating systems and one of said insulating bars and each arranged assymmetrically to the beam axis of its associated outer generating system and symmetrically to the common plane of the beam axes of said three generating systems.

6. An arrangement as defined in claim 1 wherein each said generating system includes a cathode and at least two electrodes at respectively different distances from said cathode, respective ones of said fastening clamps are associated with respective ones of said electrodes, and said clamps have coefficients of expansion such that each said clamp associated with that one of said two electrodes which is closer to its associated cathode will vary in form to a greater degree than each said clamp associated with that one of said two electrodes which is further from its associated cathode.

* * * * *